US006250744B1

(12) United States Patent
Hiraguchi et al.

(10) Patent No.: US 6,250,744 B1
(45) Date of Patent: Jun. 26, 2001

(54) PRINTING DEVICE FOR PROPELLING PRINTING MATERIAL ONTO A RECORDING MEDIUM TO FORM IMAGES

(75) Inventors: Hiroshi Hiraguchi, Toyokawa; Koji Uno, Kobe; Hirokatsu Shimada, Machida; Yoshifumi Shibata, Toyokawa; Toshio Yamaki, Takatsuki, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/265,354

(22) Filed: Mar. 9, 1999

(30) Foreign Application Priority Data

Mar. 9, 1998 (JP) ..... 10-056618

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 5,477,250 12/1995 Larson ..... 347/55
5,984,456 * 11/1999 Bern ..... 347/55

* cited by examiner

*Primary Examiner*—John Barlow
*Assistant Examiner*—Raquel Yvette Gordon
(74) *Attorney, Agent, or Firm*—Morrison & Foerster LLP

(57) ABSTRACT

A printing device includes a bearing member for bearing printing particles each having an electric charge, a backing electrode for forming an electric field between the bearing member and the backing electrode, and a substrate located between the bearing member and the backing electrode. The substrate includes a plurality of apertures. For each aperture, the substrate includes an attracting electrode and a plurality of converging electrodes. When, a first voltage is applied to the attracting electrode, the printing particles are attracted and then separated from the bearing member. Then, a second voltage is applied to the converging electrodes, the printing particles propelling in the aperture are converged. The converged printing particles are then deposited onto a recording sheet being transported to form a dot having a clear contour.

6 Claims, 3 Drawing Sheets

PRINTING DEVICE FOR PROPELLING PRINTING MATERIAL ONTO A RECORDING MEDIUM TO FORM IMAGES

RELATED APPLICATION

This application is based upon Japanese Patent Application No. 10-56618, the content of which being incorporated by reference.

FIELD OF THE INVENTION

The present invention relates to a printing device for use with an image forming apparatus such as printer, copy machine, and facsimile. In particular, the present invention relates to a printing device for propelling printing particles onto a recording medium such as plain paper to form images thereon.

BACKGROUND OF THE INVENTION

U. S. Pat. No. 5,477,250 issued on Dec. 19, 1995 discloses a printing device. The printing device includes a rotatable cylinder or toner bearing member retaining charged toner particles or printing particles on its outer periphery, and a backing electrode spaced apart from the toner bearing member. The backing electrode is electrically connected to a power source, thereby forming an electric field for attracting the charged toner particles born on the toner bearing member toward the backing electrode. Interposed between the toner bearing member and the backing electrode is an insulating plate having a plurality of apertures through which the toner particles can pass. The insulating plate is provided with individual electrodes each of which electrodes surrounding the corresponding aperture.

In operation of the printing device, when a voltage is applied to the individual electrode in response to a printing signal, the toner particles on a portion of the surface of the toner bearing member facing the electrodes are energized. The energized toner particles are propelled from the toner bearing member into the corresponding apertures, and then passed through the corresponding apertures. Subsequently, the propelled toner particles are deposited on a recording sheet travelling through a passage between the substrate and the backing electrode, thereby forming an image corresponding to the image signal on the recording sheet.

The device, however, has a drawback that the toner particles diverge while being propelled from the toner bearing member and, as a result, each resultant dot formed on the recording sheet tends to be unnecessarily large in its size and low in its density. Further, according to the printing device, an amount of the toner particles to be propelled from the toner bearing member and a size of the resultant dot formed on the recording sheet can be controlled simply by controlling a duration for applying a voltage to the individual electrodes in response to the printing signals. However, this is far from useful for solving the above-mentioned drawback of the divergence of the toner particles.

SUMMARY OF THE INVENTION

Therefore, the object of the present invention is to provide a printing device capable of converging the propelled printing particles and thereby forming dots each having a high density on the recording sheet.

To this end, a printing device includes a bearing member for bearing printing particles each having an electric charge, a backing electrode faced to the bearing member for forming an electric field between the bearing member and the backing electrode so that the printing particles are forced to the backing electrode, and a substrate made from an insulating material located between the bearing member and the backing electrode. The substrate includes a plurality of apertures through which the printing particles can pass. For each aperture, the substrate includes an attracting electrode being located adjacent to the aperture and close to the bearing member but away from the backing electrode for, when applied with a first voltage, enhancing the electric field and, thereby, propelling the printing particles from the bearing member into the corresponding apertures toward the backing electrode. The substrate further includes, for each aperture, two or more converging electrodes being located adjacent to the aperture close to the backing electrode but away from the bearing member for, when applied with a second voltage, forcing the propelling printing particles radially and inwardly and, thereby, converging the propelling printing particles.

With the printing device of the present invention, when the first voltage is applied to the attracting electrode, the toner particles on the bearing member facing the apertures are attracted intensely by the attracting electrode and, thereby, propelled away from the bearing member into the corresponding apertures toward the backing electrode. Also, by applying the second voltage to the converging electrodes, a mass of the toner particles passing through the apertures are forced to converge radially and inwardly. Then, the mass of the converged toner particles are deposited on the recording sheet moving past between the substrate and the backing electrode. Therefore, the deposited toner particles form a dot having a clear contour. Accordingly, a resultant image formed by the arrangement of dots also has a clear and precise contour.

In another aspect of the present invention, the two ore more converging electrodes include a first converging electrode, and a second converging electrode located closer to the backing electrode than the first converging electrode. The first and second converging electrodes are designed so that a force for converging the propelling printing material provided from the second converging electrode is greater than that provided from the first converging electrode. With this arrangement, the propelling printing particles in the aperture is converged step-by-step and effectively.

In another aspect of the present invention, the printing device further includes a power supply for generating the electric field between the bearing member and the backing electrode so that the printing particles are forced from the bearing member to the backing electrode. Also, the first voltage applied to the attracting electrode has a polarity opposite to that of the printing particles, and the second voltage applied to the converging electrodes has a polarity similar to that of the printing particles. In this instance, the printing particles will be converged more effectively

DETAILED DESCRIPTION OF THE PREFFED EMBODIMENTS

Figure 1:
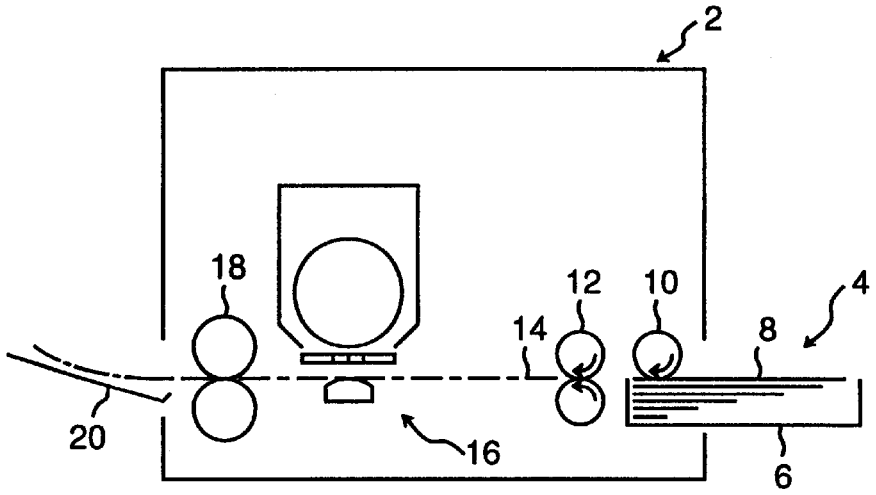
FIG. 1 is s schematic cross-sectional view of a printing device according to the present invention.

With reference to FIG. 1, there is shown a printing device according to the present invention generally indicated by reference numeral 2. The printing device 2 has a sheet feed station generally indicated by reference numeral 4. The sheet feed station 4 includes a detachable cassette 6 in which a stack of sheets 8 or plain papers are stored. A sheet feed roller 10 is disposed above the cassette 6 so that it can frictionally contact with the uppermost sheet 8 as it rotates for feeding the sheet 8 into the printing device 2. Adjacent to the sheet feed roller 10, a pair of timing rollers 12 are disposed for forwarding the sheet 8 fed from the cassette 6 along a sheet passage 14 indicated by a dotted line into a printing station generally indicated by reference numeral 16, where the printing particles are deposited thereon to form an image. Further, the printing device 2 includes a fusing station 18 for fusing and permanently fixing the image formed by the printing particles onto the recording sheet 8, and a final stack station 20 for catching the recording sheet 8 on which the image has been fused.

Figure 2:
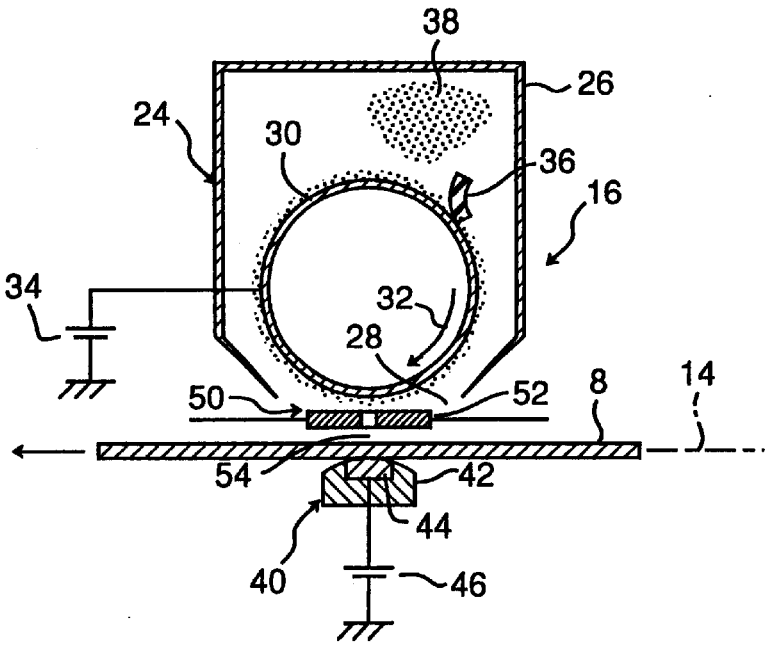
FIG. 2 is a cross sectional view of a printing station of the printing device shown in FIG. 1.

Referring to FIG. 2, the printing station 16 comprises a printing particle supply unit generally indicated by reference numeral 24 above the sheet passage 14. The supply unit 24 comprises a container 26 that has an opening 28 in a portion thereof facing the sheet passage 14. Adjacent to the opening 28, a developer roller 30 is supported for rotation in a direction indicated by an arrow 32. The developer roller 30 is made of conductive material and is electrically connected to a DC power source 34. A blade 36, preferably made from a plate of an elastic material such as rubber or stainless steel, is disposed in contact with the developer roller 30.

The container 26 accommodates toner particles or printing particles 38. The toner particles 38 are supplied onto an outer surface of the developer roller 30 by means of supply rollers (not shown), and then transported by the rotation of the developer roller 30. The toner particles 38 retained on the developer roller 30 are then transported into a contact region of the developer roller 30 and the blade 36, where the toner particles 38 are brought into frictional contact with the blade 36 and thereby charged with a certain polarity. In this embodiment, the toner particles 38 capable of being charged with negative polarity by the contact with the blade 36 are used. Therefore, each incremental portion of the outer periphery of the developer roller 30 which has moved past the contact region of the developer roller 30 and the blade 36 bears a thin layer of negatively charged toner particles 38. Also, since the developer roller 30 is applied with a positive voltage by the power source 34, the negatively charged toner particles 38 are electrically attracted by and retained on the developer roller 30.

A electrode unit generally indicated by reference numeral 40 is disposed under the supply unit 24 and the sheet passage 14. The electrode unit 40 includes a support 42 made of electrically insulating material, and a backing electrode 44 made of electrically conductive material. The backing electrode 44 is electrically connected to a power source 46 so that a voltage of a certain polarity (in this embodiment, positive polarity) is applied to the backing electrode to form an electric field between the developing roller 30 and the backing electrode. As a result, the negatively charged toner particles 38 on the developer roller 30 are forced electrically toward the backing electrode 44. However, by the control of the output voltage of the power source 46, an intensity of the electric field is controlled so that it is not sufficient for the toner particles 38 to propel away from the developer roller 30.

Figure 3:
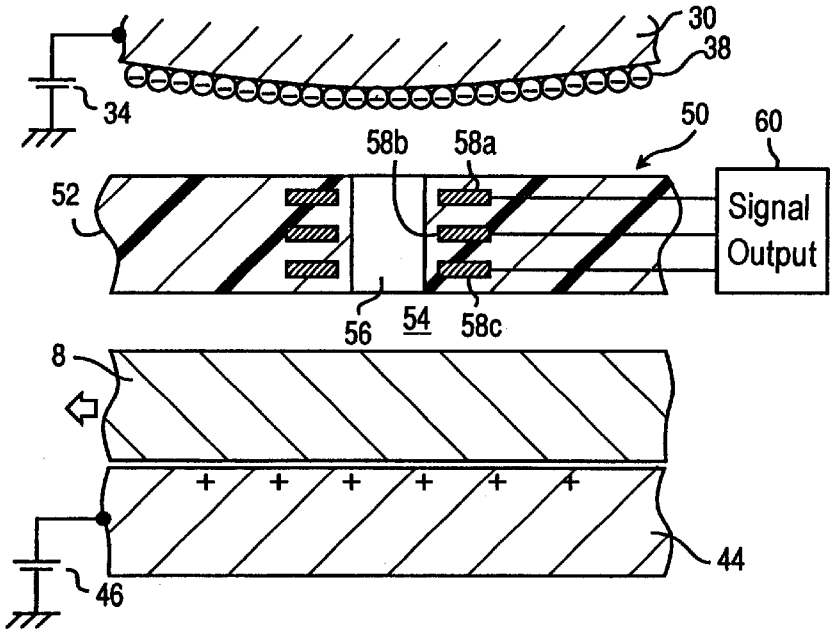
FIG. 3 is an enlarged fragmentary cross sectional view of a printing zone of the printing device shown in FIG. 1.

A substrate generally indicated by the reference numeral 50 is disposed between the printing particle supply unit 24 and the electrode mechanism 40, and above the sheet passage 14. Preferably, the substrate 50 is made from a flexible printed circuit board 52, having a thickness of about 100 to 200 $\mu$m. As shown in FIG. 2 and 3, a portion of the substrate 50 located in a printing zone 54 where the developer roller 30 faces the backing electrode 44 includes a plurality of apertures 56 each having a diameter of about 25 to 200 $\mu$m which is substantially larger than an average diameter of the toner particles 38 (normally about from several to slightly over 10 $\mu$m). The apertures 56 are arranged at regular intervals on a line extending perpendicular to a sheet transporting direction.

Figure 4:
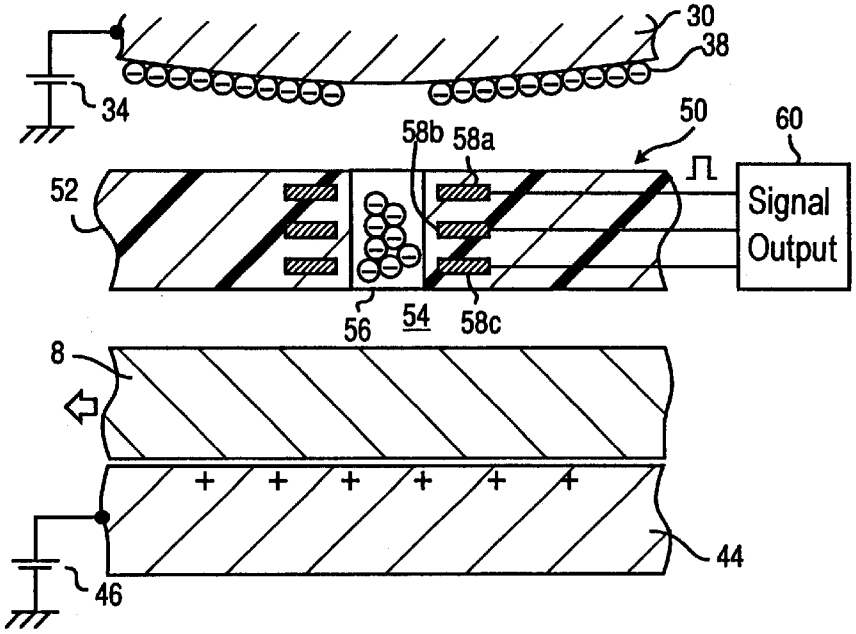
FIG. 4 is also an enlarged fragmentary cross sectional view of the printing zone of the printing device shown in FIG. 1, showing toner particles propelling in an aperture.

As best shown in FIGS. 3 and 4, three individual electrodes 58*a*, 58*b*, and 58*c* are provided adjacent to each aperture 56, each of which individual electrodes being in the form of ring or doughnut and surrounding the aperture. In this embodiment, the electrode 58*a* positioned adjacent to the developing roller 30 is referred to as attracting electrode, and the electrode 58*c* positioned adjacent to the backing electrode 44 and the electrode 58*b* positioned between the electrodes, 58*a* and 58*c*, are referred to as converging electrodes, as necessary. Also, the electrodes 58*a*–58*c* are connected to a signal output 60 so that each of the electrodes 58*a*–58*c* is to be applied with respective signals in response to an image signal from the signal output 60.

Figures 5A, 5B, 5C:
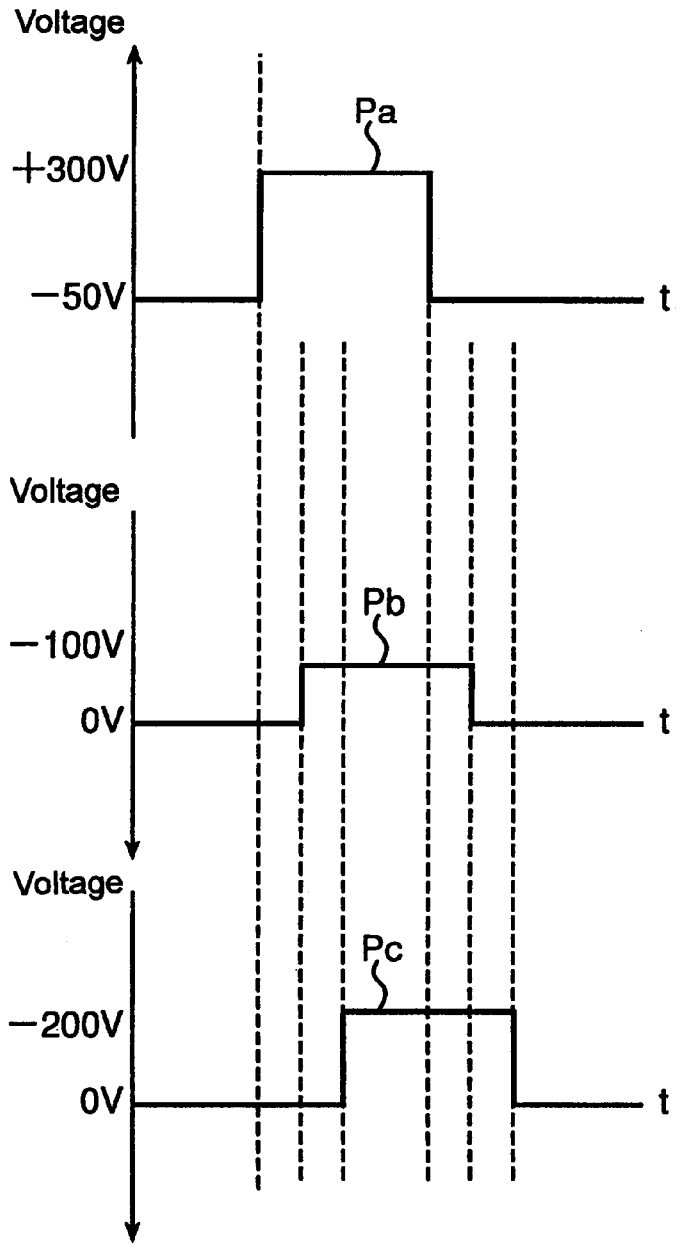
FIGS. 5A to 5C show waveforms of image signals applied to individual electrodes.

FIGS. 5A to 5C show waveforms of the signals provided from the signal output 60 to the individual electrodes 58*a*–58*c*, respectively. The waveform of the signal to be applied to the individual electrode 58*a*, shown in FIG. 5A, indicates that, at non-printing, a DC bias of −50V having the same polarity as that of the toner particle is constantly applied to the electrode 58*a*. Also indicated is that, at printing, in response to the image signal, a pulse Pa of +300V having a polarity opposite to that of the toner particle is applied to the electrode 58*a*. The pulse Pa is a composition and can be obtained by the superposition of the DC voltage of −50V and a pulse having a peak voltage of +350V.

On the other hand, the waveform of the signal to be applied to the individual electrode 58*b*, shown in FIG. 5B, indicates that the electrode 58*b* is applied with a pulse Pb of −100V having a polarity opposite to that of the toner particle in response to the image signal. Likewise, the waveform of the signal to be applied to the individual electrode 58*c*, shown in FIG. 5C, indicates that the electrode 58*c* is applied with a pulse Pc of −200V having a polarity opposite to that of the toner particle and greater in voltage than the pulse Pb in response to the image signal.

Having described the construction of the printing device 2, its operation will now be described. As shown in FIG. 2, the developer roller 30 in the supply unit 24 rotates in a direction indicated by the arrow 32. The toner particles 38 are deposited on the developer roller 30 and then transported by the rotation of the developer roller 30 into a contact region of the blade 36 and the developer roller 30 where the toner particles 38 are provided with negative charge by the frictional contact with the blade 36. Thereby, as shown in FIG. 3, each incremental portion of the roller 30 having passed the contact region bears on its outer surface a thin layer of the negatively charged toner particles 38.

At non-printing or waiting, the attracting electrode 58*a* is biased to −50V and no voltage is applied to the converging electrodes, 58*b* and 58*c*. Accordingly, the toner particles 38 are retained on the surface of the developer roller 30, without being propelled toward the backing electrode 44.

At printing, in response to an image signal from the signal output 60, the composite pulse Pa of +300V is applied to the attracting electrode 58*a* from the signal output 60, thereby enhancing the electric field. Due to the enhancement of the electric field, as best shown in FIG. 4, the toner particles 38, having negative polarity and retained on a portion of the surface of the developer roller 30 facing the attracting electrode 58*a*, are separated from the developer roller 30 by the attracting electrode 58*a*. The separated toner particles 38 are then propelled into the corresponding apertures 56 with an aid of the attraction force generated by the backing electrode 44.

When the toner particles 38 propelling past in the aperture have reached a portion close to the first converging electrode 58*b*, the pulse Pb of −100V having a negative polarity is applied to the first converging electrode 58*b*. As a result, since the propelling toner particles 38 have the same negative polarity, they are forced to converge inwardly toward the center of the aperture 56 by the electrical repelling force surrounding them.

Then, when the toner particles 38 have reached a portion close to the second converging electrode 58*c*, the pulse Pc of −200V having a negative polarity is applied to the second converging electrode 58*c*. Since the voltage of pulse Pc (−200V) is greater than that of Pb (−100V), the toner particles 38 are subjected to a greater inward force and thereby further converged radially and inwardly. This results in that a mass of the converged toner particles 38 is deposited on the recording sheet 8 being transported in the printing area 54, forming a dot on the recording sheet 8. Consequently, each dot formed on the recording sheet 8 by the converged toner particles 38 has clear contour and high density.

Subsequently, the recording sheet 8 bearing the deposited toner particles 38 is transported to the fusing device 18 where the toner particles 38 are fused and permanently fixed on the recording sheet 8, and then finally fed out onto the final stack station 20 or catch tray.

As explained in the above, according to the present invention, when forming images, both two converging electrodes 58*b* and 58*c* are applied with a voltage having a negative polarity similar to that of the toner particles 38 passing through the aperture. This causes the toner particles to converge, resulting in that each dot made of the converged toner particles on the recording sheet has a continuous and clear contour. Accordingly, the image generated by an assembly of the dots naturally has a clear contour as well.

Also, in the previous embodiment, the image signal of pulse Pb is first applied to the first converging electrode 58*b* and, after a short while, the image signal of pulse Pc is biased to the second converging electrode 58*c*. This causes the toner particles passing in the aperture to converge step-by-step and effectively.

Although in the printing device of the previous embodiment one attracting electrode is provided for one aperture, a plurality of the attracting electrodes may be provided. In this instance, a greater amount of toner particles will be attracted into the apertures, which results in higher density images. Likewise, in the printing device in the previous embodiment, two converging electrodes are provided for one aperture, the present invention is not limited thereto and more number of converging electrodes may be provide.

Various changes and modifications may be made to the invention and the embodiments explained in the above for those skilled in the art, but all of which should fall within a scope of this invention. It should also be understood that all matters described in the above or shown in the accompanying drawings are for illustrative purposes only, and should not be construed in a limiting sense.

What is claimed is:

1. A printing device, comprising:

a bearing member for bearing charged printing particles;

a backing electrode facing said bearing member for forming an electric field between said bearing member and said backing electrode for propelling said printing particles toward said backing electrode;

a substrate made from an insulating material and located between said bearing member and said backing electrode, said substrate having a plurality of apertures formed therein through which said printing particles can pass;

said substrate further comprising, for each of said apertures, an attracting electrode located adjacent to said aperture closer to said bearing member than said attracting electrode is located away from said backing electrode for, when a first voltage is applied to said attracting electrode, enhancing said electric field and propelling said printing particles from said bearing member into corresponding apertures toward said backing electrode and a plurality of converging electrodes located adjacent to said aperture closer to said backing electrode than said converging electrodes are located away from said bearing member for, when a second voltage is applied to said converging electrodes, forcing said propelled printing particles radially inwardly and thereby converging said propelled printing particles, said plurality of converging electrodes being aligned in the direction of the electric field between the bearing member and the backing electrode.

2. A printing device, comprising:

a bearing member for bearing charged printing particles;

a backing electrode facing said bearing member for forming an electric field between said bearing member and said backing electrode for propelling said printing particles toward said backing electrode;

a substrate made from an insulating material and located between said bearing member and said backing electrode, said substrate having a plurality of apertures formed therein through which said printing particles can pass;

said substrate further comprising, for each of said apertures, an attracting electrode located adjacent to said aperture closer to said bearing member than said attracting electrode is located away from said backing electrode for, when a first voltage is applied to said attracting electrode, enhancing said electric field and propelling said printing particles from said bearing member into corresponding apertures toward said backing electrode and a plurality of converging electrodes located adjacent to said aperture closer to said backing electrode than said converging electrodes are located away from said bearing member for, when a second voltage is applied to said converging electrodes, forcing said printing particles radially inwardly and thereby converging said propelled printing particles, wherein said plurality of converging electrodes comprises a first converging electrode; and a second converging electrode located closer to said backing electrode than said first converging electrode, said first and second converging electrodes being configured so that a force for converging said propelled particles provided by said second converging electrode is greater than that provided by said first converging electrode.

3. A printing device according to claim 2, further comprising:

a power supply for generating said electric field between said bearing member and said backing electrode so that said printing particles are forced from said bearing member to said backing electrode;

wherein said first voltage applied to said attracting electrode has a polarity opposite to that of said printing particles; and said second voltage applied to said converging electrodes has a polarity similar to that of said printing particles.

4. A printing device according to claim 2, further comprising a controller for providing the first voltage and the second voltage such that the first voltage is applied to the attracting electrode for propelling the printing particles from the bearing member, the second voltage for the first converging electrode is applied to the first converging electrode when the printing particles reach a vicinity of the first converging electrode, and the second voltage for the second converging electrode is applied to the second converging electrode when the printing particles reach a vicinity of the second converging electrode.

5. A printing device according to claim 1, further comprising:

a power supply for generating said electric field between said bearing member and said backing electrode so that said printing particles are forced from said bearing member to said backing electrode;

wherein said first voltage applied to said attracting electrode has a polarity opposite to that of said printing particles; and said second voltage applied to said converging electrodes has a polarity similar to that of said printing particles.

6. A printing device according to claim 1, further comprising a controller for providing the first voltage and the second voltage such that the first voltage is applied to the attracting electrode for propelling the printing particles from the bearing member, the second voltage for a first converging electrode is applied to the first converging electrode when the printing particles reach a vicinity of the first converging electrode, and the second voltage for a second converging electrode is applied to the second converging electrode when the printing particles reach a vicinity of the second converging electrode.

* * * * *

UNITED STATES PATENT AND TRADEMARK OFFICE

CERTIFICATE OF CORRECTION

PATENT NO. : 6,250,744 B1
DATED : June 26, 2001
INVENTOR(S) : Hiroshi Hiraguchi et al.

It is certified that error appears in the above-identified patent and that said Letters Patent is hereby corrected as shown below:

Title page,
Item [73] Assignee: Add -- Array Printers AB, Vastra Frolunda, Sweden. --

Signed and Sealed this

Twenty-third Day of October, 2001

*Attest:*

Nicholas P. Godici

*Attesting Officer*

NICHOLAS P. GODICI
*Acting Director of the United States Patent and Trademark Office*